United States Patent [19]

Jaecklin

[11] Patent Number: 4,818,150

[45] Date of Patent: Apr. 4, 1989

[54] WALL WITH GRAVITY SUPPORT STRUCTURE, BUILDING ELEMENT AND METHOD FOR CONSTRUCTION THEREOF

[75] Inventor: Felix P. Jaecklin, Ennetbaden, Switzerland

[73] Assignee: Geotech-Lizenz AG, Switzerland

[21] Appl. No.: 904,643

[22] Filed: Sep. 8, 1986

[30] Foreign Application Priority Data

Sep. 12, 1985 [DE] Fed. Rep. of Germany ..... 3532641

[51] Int. Cl.[4] ..... E02D 29/02; E02D 17/20

[52] U.S. Cl. ..... 405/262; 405/258; 405/284

[58] Field of Search ..... 405/258, 262, 284, 285, 405/286, 287

[56] References Cited

U.S. PATENT DOCUMENTS

| | | | |
|---|---|---|---|
| 3,922,864 | 12/1975 | Hilfiker | 405/286 X |
| 4,117,686 | 10/1978 | Hilfiker | 405/284 |
| 4,329,089 | 5/1982 | Hilfiker et al. | 405/262 |
| 4,391,557 | 7/1983 | Hilfiker et al. | 405/284 X |
| 4,490,075 | 12/1984 | Risi et al. | 405/286 X |
| 4,512,685 | 4/1985 | Hegle | 405/284 |
| 4,557,634 | 12/1985 | Vidal | 405/284 X |
| 4,671,706 | 6/1987 | Giardini | 405/286 |

FOREIGN PATENT DOCUMENTS

| | | | |
|---|---|---|---|
| 0134969 | 4/1979 | German Democratic Rep. | 405/284 |
| 0089536 | 7/1980 | Japan | 405/284 |
| 0657651 | 9/1986 | Switzerland | 405/285 |
| 0647391 | 2/1979 | U.S.S.R. | 405/284 |
| 1485004 | 9/1977 | United Kingdom | 405/284 |
| 2073281 | 10/1981 | United Kingdom | 405/284 |
| 2102866 | 2/1983 | United Kingdom | 405/284 |

*Primary Examiner*—Dennis L. Taylor
*Attorney, Agent, or Firm*—Lalos & Keegan

[57] ABSTRACT

The wall according to the present invention comprises a gravity support structure with a plurality of compartments or cells which are filled with bulk-material and surrounded or subdivided by flat and flexible envelope material, and on one front side or on both opposite front sides of this gravity support structure a fore-part, preferably in the form of a supporting grid structure, which is positively or frictionally connected with said gravity support structure. Such combined wall structure can be used for slope supporting as well as for noise absorbing or partition purposes, in the latter cases e.g. in the form of a stand-alone structure. An essential function of the fore-parts is the protection of the front portions of the envelope material holding the bulk material filling against violation and solar irradiation. The stability of the combined wall is greatly enhanced by anchoring the fore-parts to the gravity support structure by means of comparatively inexpensive tensile elements.

9 Claims, 8 Drawing Sheets

WALL WITH GRAVITY SUPPORT STRUCTURE, BUILDING ELEMENT AND METHOD FOR CONSTRUCTION THEREOF

BACKGROUND OF THE INVENTION

Walls constructed as a gravity support structure with bulk material cells enveloped by flexible flat material such as foils or tissue of synthetic resins or plastic material are well-known. they are in use particularly for supporting slopes. The front side of such a gravity support structure generally is formed by the front portions of the bulk material compartments or cells, i.e. by the front portions of the envelopes, which stand under the internal pressure of the bulk material filling and accordingly are forming convex vaults. The bulk material cells superimposed to each other are in mutual positive or at least frictional, shear resistant connection. This results in an enhanced stability and support capability, especially against the horizontally acting pressure component of a slope located behind the gravity support structure. Due to their simple production and reduced expenses there is an increasing demand for the application of such structures.

However, there are problems due to the envelope material being sensitive against violation by piercing or tearing with the consequence of the bulk material running out and leaving the structure instable. Further difficulties arise from the sensitiveness of the envelope material against solar irradiation. Providing an earth slope in contact with the front of the structure, which could shield the envelope against irradiation and besides facilitate planting, generally is difficult in view of poor connection between the smooth surface of the envelope material and the earth of the slope, which leads to separation due to natural settling of the earth and to undesired exposition of the envelope material.

SUMMARY OF THE INVENTION

It is a major object of the invention to create a wall construction comprising a gravity support structure with a plurality of cells which are filled with bulk material and surrounded or subdivided by flat and flexible envelope material, in which the front faces of said compartments and particularly the exposed portions of the envelope material are efficiently protected, whilst the advantages concerning stability and inexpensive production are preserved, particularly in case of constructions with comparatively steep front faces.

The solution to this object is mainly established by a wall construction comprising a gravity support structure with a plurality of cells which are filled with bulk material and surrounded or subdivided by flat and flexible envelope material, the wall being provided with at least one fore-part which is positively or frictionally connected with said gravity support structure at least with regard to horizontal forces acting between said fore-part and said gravity support structure.

The structure offers essential advantages over the usually designed walls merely consisting of a supporting grid composed of frame-like elements: A major part of the whole structure volume and weight necessitated by a certain requested tilting resistane or slope supporting capability can be realized by said gravity support structure being much less expensive. The fore-parts make it possible to provide a front face structured by ribs and recesses so as to offer best noise absorption and to form receptacles for earth to bear plants, particularly in case of having a grid support structure filled with earth as fore-part.

Due to the gravity support structure taking over a great part of the stabilizing function the fore-parts can be reduced considerably as to their dimensions, especially their wall-thickness, and accordingly to the expenses.

For the purpose of anchoring the fore-parts to the gravity support structure preferably appropriate portions of the envelope material already present in the gravity support structure may be used. In the case of a stand-alone wall with two fore-parts on opposite front sides of a centrally located gravity support structure stability may be further enhanced substantially without additional expenses by connecting the opposite fore-parts or certain building elements thereof, which preferably are located on not too much different levels, directly with each other by means of tensile anchoring elements extending through the central gravity support structure.

Certain building elements as disclosed and claimed hereinafter and being useful in the construction of walls of the kind just defined are within the scope of the present invention.

An essential variation also lying within the scope of the present invention is accomplished by a wall, particularly constructed as a slope-supporting wall or a stand-alone wall such as a noise-absorbing or partition wall, comprising a gravity support structure with a plurality of cells which are filled with bulk material and surrounded or subdivided by flat and flexible envelope material, the wall being provided with at least one fore-part which is constructed so as to be tilt-resistant in itself and arranged without substantial force transmission in relation to said gravity support structure.

This solution is applicable particularly in cases where stability is not the critical point and served well by a comparatively heavy gravity support structure as well as by the fore-part, i.e. by both components substantially independent from each other. Preferably this may be valid for one-side fore-parts in contrast to stand-alone walls. The essential feature of the invention used in such variations is the protective function of the fore-part with regard to the front of the gravity support structure with its sensitive envelope material.

Effective and comparatively inexpensive methods for constructing walls according to the last-mentioned variation, which particularly facilitate holding the fore-part free of the bulk material pressure within the cells of the gravity support structure, as disclosed and claimed hereinafter are also within the scope of the invention.

DETAILED DESCRIPTION OF THE INVENTION

Figure 1:
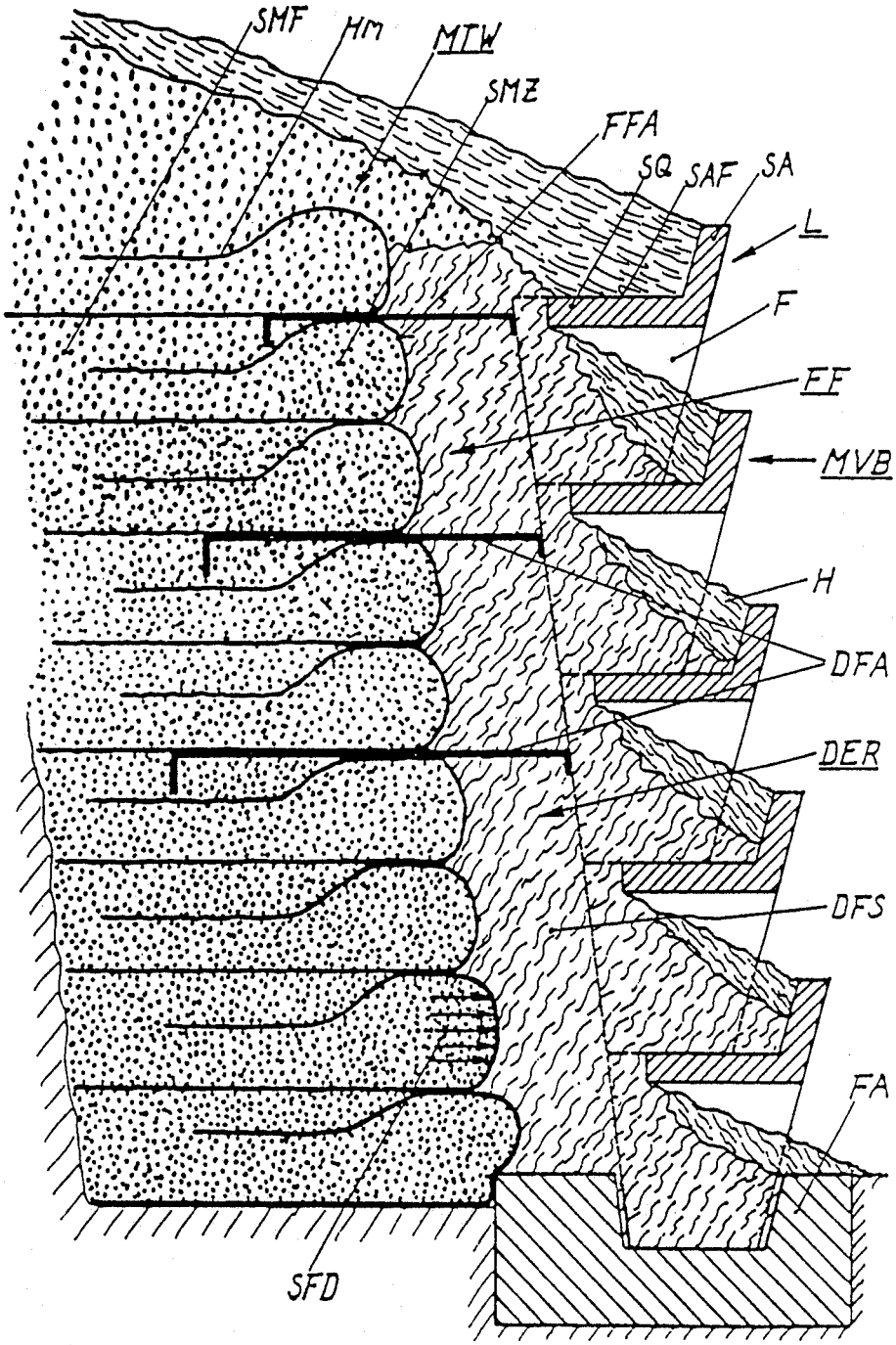
FIG. 1 is a cross-sectional elevational view of a slope supporting wall with bulk material compartments superimposed on a flat material envelope.

The invention now will be explained more in detail with reference to the examples schematically shown in the drawings.

The example of FIG. 1 is a slope supporting wall including a gravity support structure MTW consisting of superimposed compartments or cells SMZ with a bulk material filling SMF and a flexible flat material envelope HM. The front face FF of the gravity support structure is formed by front portions FFA of the envelopes carrying the horizontal component of the bulk material pressure SFD and being vaulted thereby. In front of the face FF there is a pressure relief space DER containing pressureless or low-pressure filling DFS of comparatively incompact or low-densified bulk material. Distance elements DFA arranged to extend through the pressure relief space DER are anchored with their rear ends between horizontal boundaries of cells SMZ so as to transfer substantially no bulk material pressure in a direction from the gravity support structure to a fore-part MVB located in front of space DER, but rather to transfer support forces from the fore-part backwards into the gravity support structure. The fore-part MVB consists of elements L superimposed to each other and resting on a base FA. Elements L are formed as longitudinal beams extending in parallel to the wall, which has been shown in a vertical section, and comprise a transverse profile leg SQ as well as an upright profile leg SA and base sections F holding distance from the lower adjacent building element L. On their upper surface the profile legs SQ are forming a bearing face SAF for the parts of bulk material filling DFS running through the horizontal distances between adjacent base sections F and for a superimposed humus layer H intended to carry plants. Due to the small dimensions of its building elements in a direction transverse to the wall and due to the small bearing surfaces between adjacent building elements the fore-part MVB has only little inherent stability and, therefore, is secured against tilting by its inclined position with leaning against the gravity support structure through distance elements DFA and eventually through low-pressure filling DFS. The fore-part thus can be of comparatively light and inexpensive construction, nevertheless fulfilling its protective function for the sensitive front face FF as well as offering optimum conditions for noise absorption, planting and esthetic appearance at the wall front.

Figure 2:
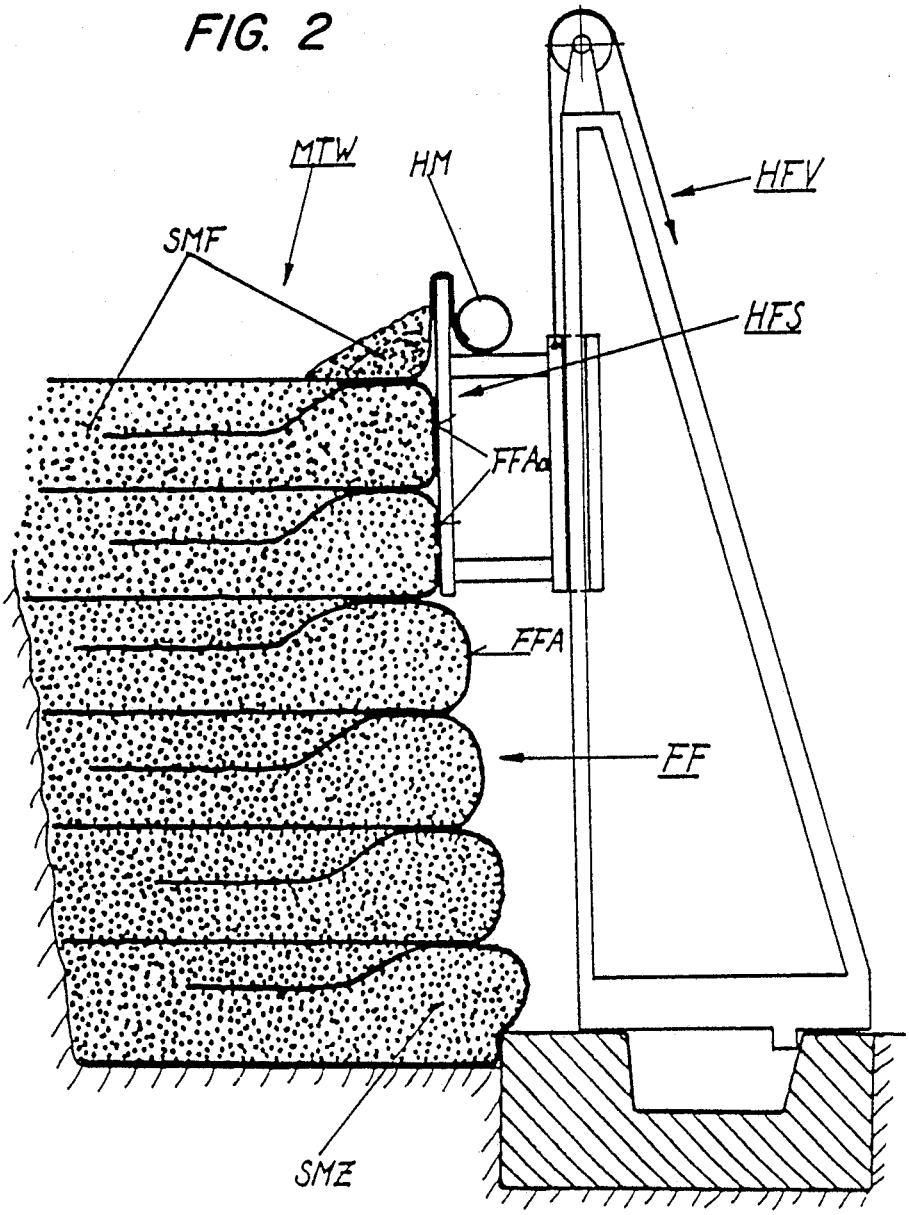
FIG. 2 is an elevational view of a slope supporting wall and apparatus for constructing the wall according to a first method.
Figure 3:
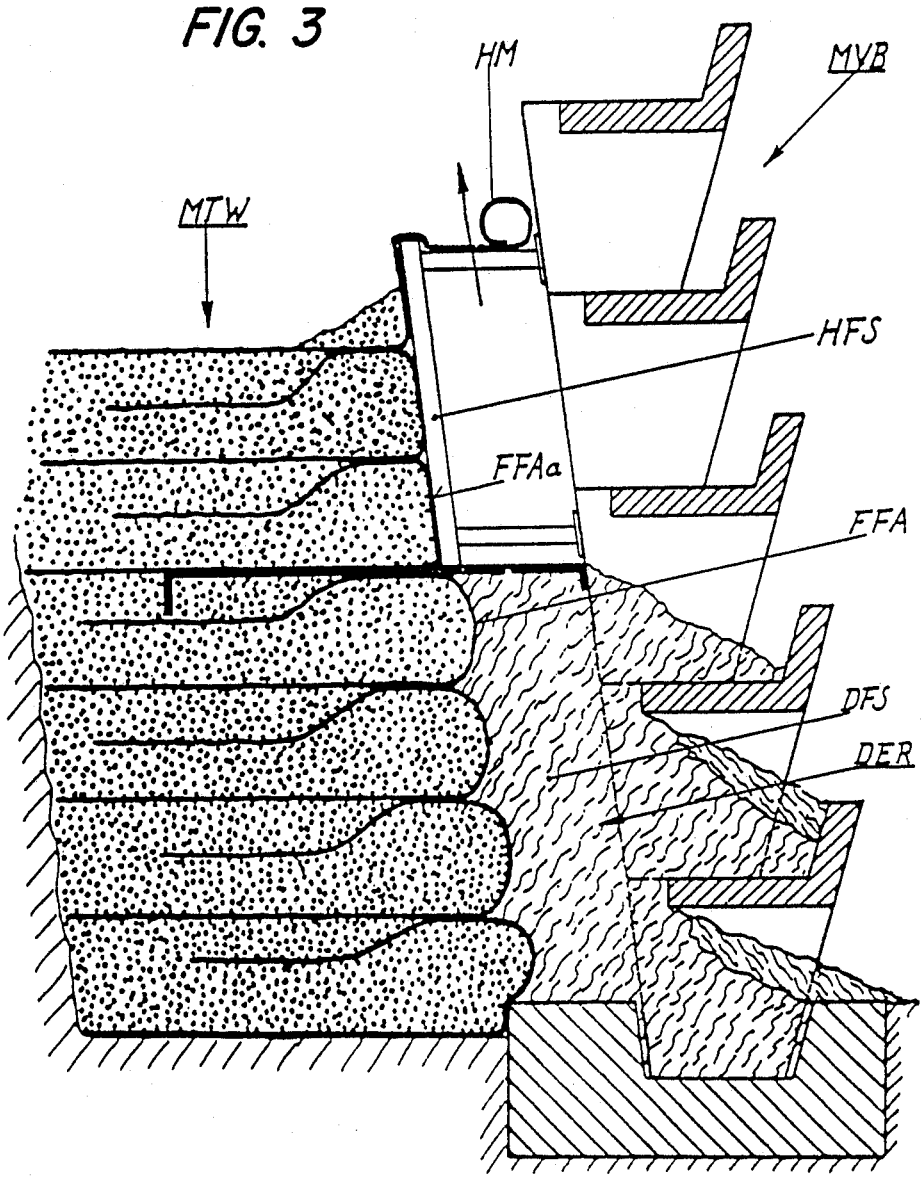
FIG. 3 is an elevational view of a slope supporting wall and apparatus for constructing the wall according to a second method.

Manufacture of the wall according to FIG. 1 can be accomplished by using the methods illustrated in FIG. 2 and 3 respectively.

According to FIG. 2 first of all the gravity support structure MTW is erected by sections with the aid of an auxiliary shuttering HFS supporting the envelope front portions FFA by sections correspondingly. For this purpose the shuttering HFS can be lifted by means of an elevating and guiding device HFV. Below of the momentary working position of the auxiliary shuttering shown in the upper part of FIG. 2 with supported front portions FFAa the front face FF is relieved from the shuttering such that the envelope front portions FFA can get under tension and balance the bulk material pressure SFD. Thereafter the fore-part MVB can be erected without being disturbed by pressure coming from the supported slope or from the bulk material filling. Then the low-pressure filling DFS is introduced together with positioning the distance elements DFA.

In contrast thereto, according to FIG. 3 first of all the fore-part is erected as a whole or by sections. Then the gravity support structure is erected by sections with the aid of movable auxiliary shutering HFS, which at any time has to balance merely a small part of the bulk material pressure acting in a few cells of the gravity support structure and, therefore, is allowed to be supproted intermediately by the fore-part. Below the auxiliary shuttering the envelope material of the front face is tensioned by the bulk material pressure, thus far relieving the fore-part. The low-pressure filling and distance elements can be introduced by steps correspondingly so as to definitely support the fore-part in a horizontal direction and to accomplish sufficient stability.

Figure 4:
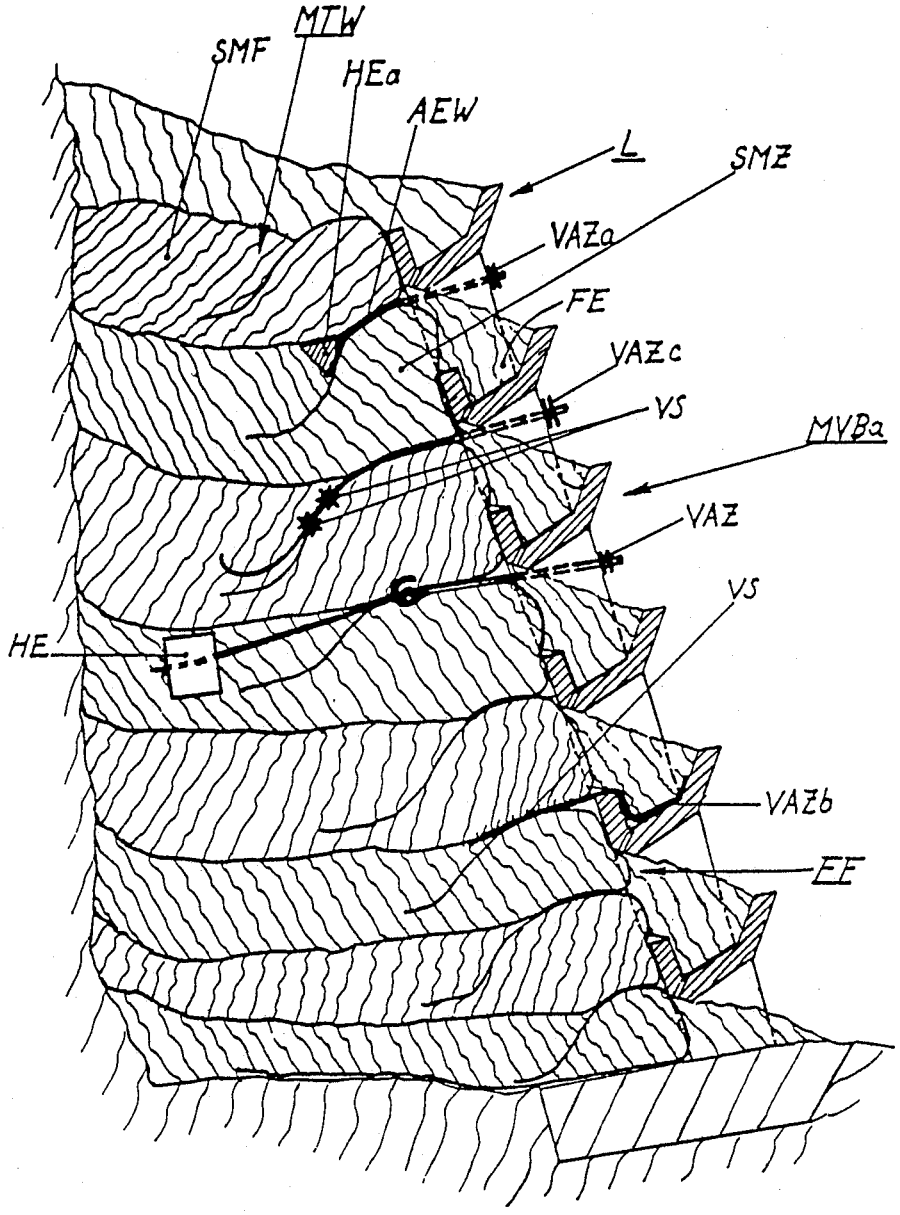
FIG. 4 is a cross-sectional view of a slope supporting wall and illustrating various anchoring elements.

FIG. 4 illustrates—again in a vertical cross-section—a fore-part MVBa having no inherent stability and comprising building elements L in the kind of longitudinal beams with groove profile and base elements FE. Such fore-part has stability only through the positive connection with the previously erected gravity support structure MTW by means of anchoring elements VAZ, VAZa or VAZb respectively, which are constructed so as to transfer tensile forces. The fore-part is relieved from the horizontal slope pressure and bulk material pressure due to its compliance.

The anchoring element VAZ is connected to the gravity support structure by means of a holding part HE embedded in the bulk material filling SMF. The same is valid for anchoring element VAZa with regard to holding part HEa, which supports itself between converging envelope sections and transfers its tensile force through a rope-like, elastic connection part AEW to the fore-part MVBa in a manner adaptive to transversal displacement. Thereagainst anchoring elements VAZb and VAZc are connected positively or bondingly in a concentrated or distributed manner to substantially horizontal or slowly inclined extending sections of the envelope material HM by means of differently shaped connection elements VS capable of transferring shear forces. For the anchoring element VAZb provision is made for a particularly simple, frictional connection to the corresponding building element L of fore-part MVBa, which connection is effective under load by a bulk material in the groove profile of said front building element L.

Figure 5:
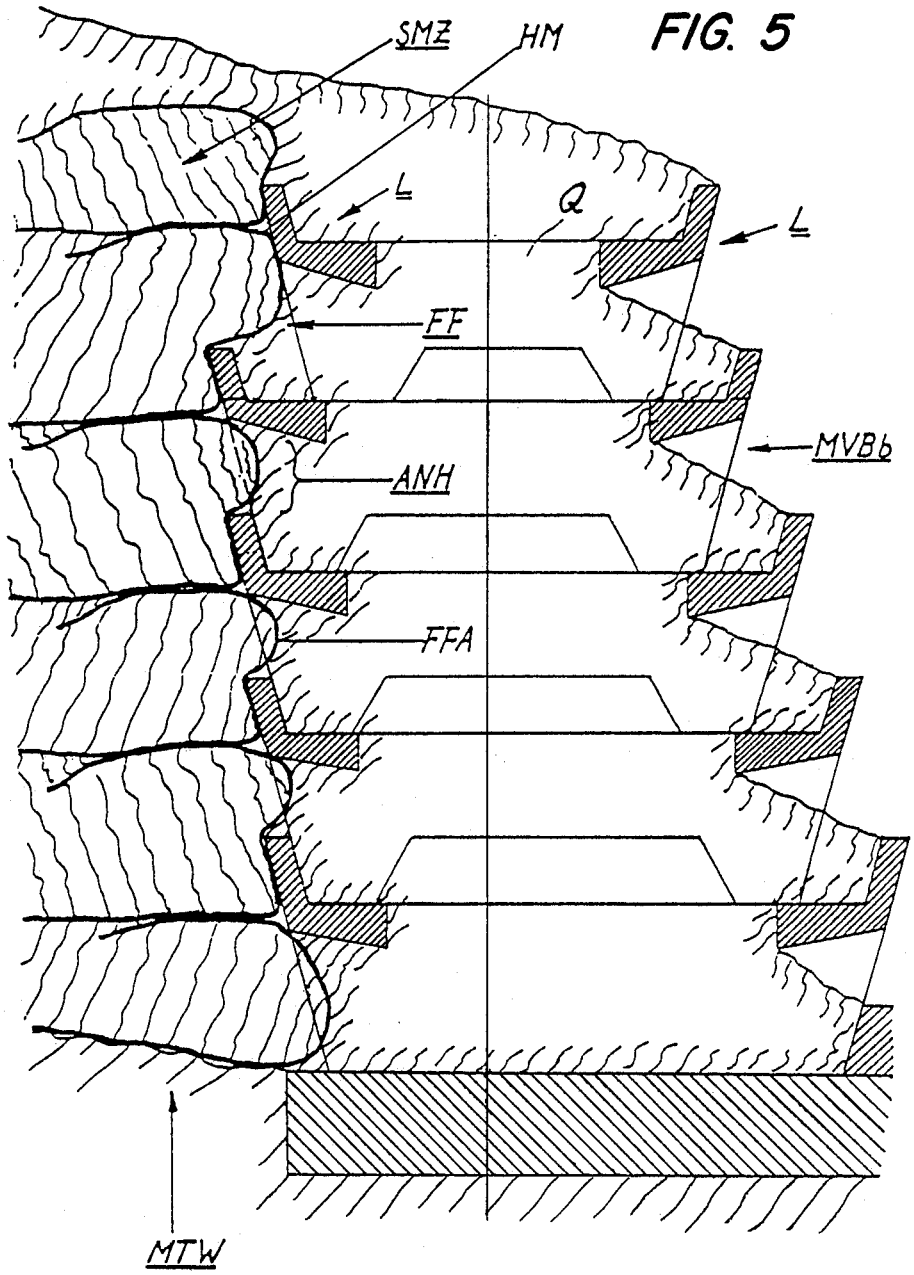
FIG. 5 is a cross-sectional view of a slope supporting wall with transverse beams for enhanced wall stability.

FIG. 5 illustrates a fore-part MVBb of enhanced inherent stability with superimposed corner-profile longitudinal beams L and transverse beams Q having a great depth measured in a direction transverse to the wall as well as their own bulk material filling enhancing the stability. On the backside of fore-part excavations ANH are formed between the superimposed building elements. Convex vaulted envelope front portions FFA standing under the bulk material pressure are arranged to engage these excavations so as to form a positive connection. The wall as a whole is of enhanced compound stability and support capability, suitable for carrying extremely heavy loads. In case there is a distance space between the gravity support structure and the forepart, providing a highly densified bulk material therein is favoured.

Figure 6:
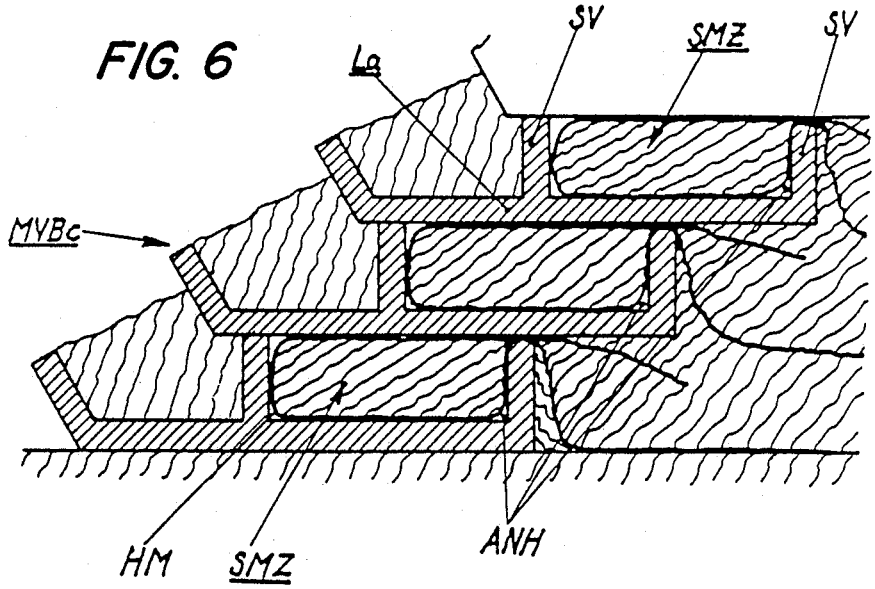
FIG. 6 is a cross-sectional view of a slope supporting wall including longitudinal ribs for forming a positive connection between the fore-part of the wall and the main support structure of the wall.
Figure 7:
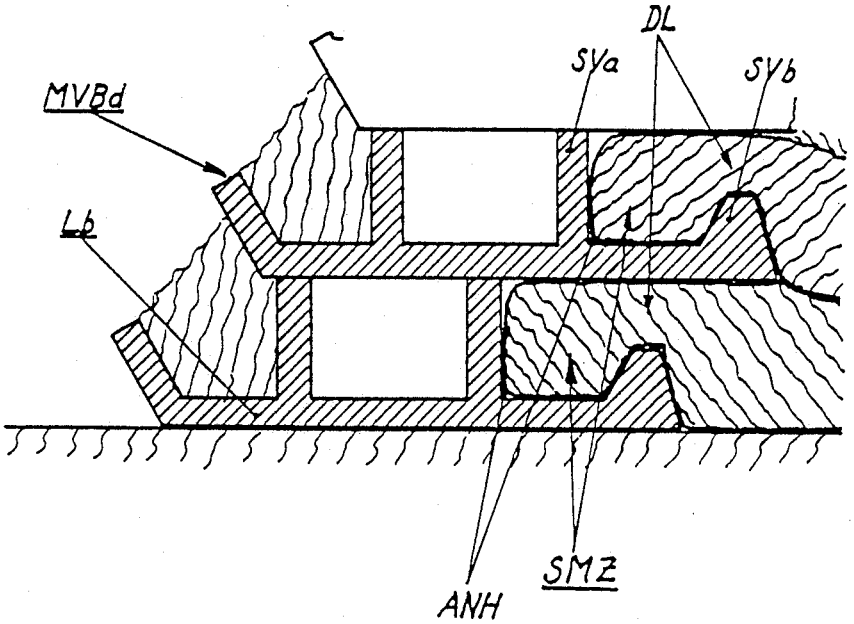
FIG. 7 is a variation of the slope supporting wall shown in FIG. 6 in which the height of the ribs is reduced.
Figure 8:
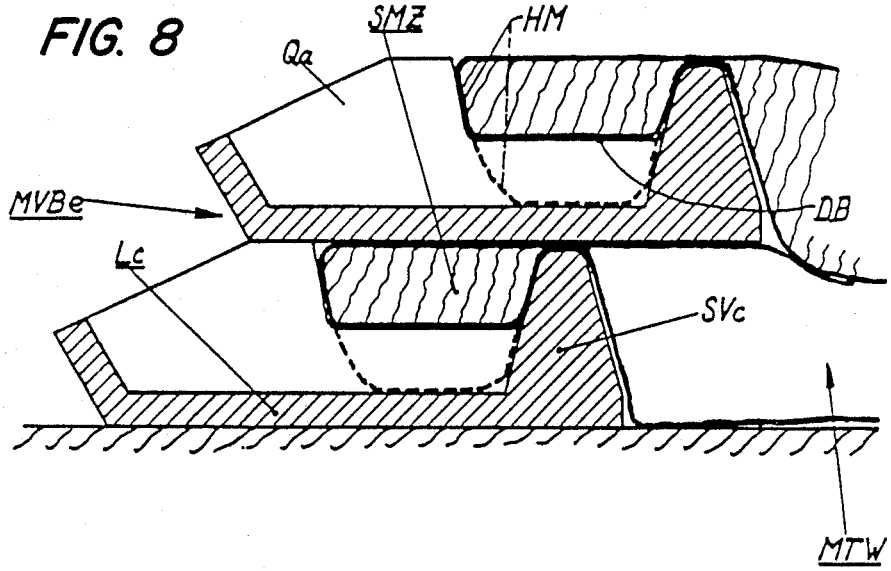
FIG. 8 is a cross-sectional side view of a slope supporting wall in which the fore-part comprises trough-like building elements.

FIGS. 6 to 8 further illustrate positive connections between fore-parts MVBc, MVBd and MVBe, which are space grid support structures comprising groove profile beams La, Lb and Lc respectively as superimposed building elements and a gravity support structure MTW arranged behind the foreparts. To be pointed out for all these variations is the simplicity as well as efficiency of the tensile connection between fore-part and gravity support structure in all these variations. Therefore, these constructions—thus far deviating from the illustrations—are particularly suitable with regard to fore-parts without inherent stability in connection with a gravity support structure.

Tensile anchoring is accomplished by means of envelopped bulk material cells SMZ, the pocket-like front portions thereof engaging excavations ANH of the fore-part. Behind such excavations i.e. adjacent to the gravity support structure, there are projections directed upwards and acting as abutments for tensile forces transferred by the bulk material cells.

In the examples as shown the projections are formed by ribs or profile legs extending substantially in parallel to the plane of the wall, however, if desired they can be shaped as single elements—particularly in a serial arrangement—on the building elements of the fore-part.

According to FIG. 6 an excavation ANH is formed between two longitudinal ribs or profile legs SV, the cross-section of which is directed upwards. The back one of these ribs or profile legs is acting as an abutment for tensile forces. The corresponding conditions apply to the variation according to FIG. 7, which has two longitudinal ribs SVa and SVb, the latter again acting as an abutment for tensile forces. It has an upper edge of reduced height so as not to squeeze off the bulk material cell housed in the excavation, but rather to offer a greater passage for connection thereof with the gravity support structure. This facilitates the desired filling equalization of the bulk material in the construction of the wall and, therefore, an easier and more precise filling up of the excavations, thus establishing a correct positive connection.

Figure 9:
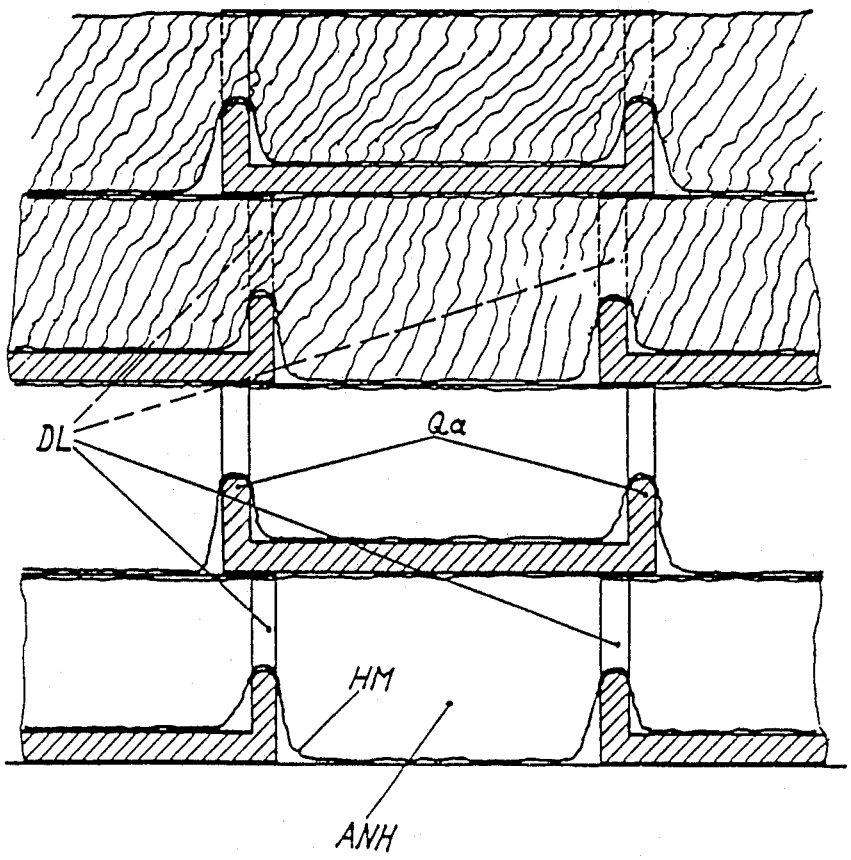
FIG. 9 is a cross-sectional front view of the slope supporting wall shown in FIG. 8.

In the variation according to FIGS. 8 and 9 being a vertical cross-section and a vertical longitudinal section respectively, the fore-part consists of trough-like, comparatively narrow building elements Lc with longitudinal back rib SVc and transversal walls Qa on both sides. Both Walls Qa have upper edges of equal height so as to offer a securely tiliting-resistant for the superimposed building element Lc. Passages DL formed in said transversal walls Qa make sure that each bulk material cell SMZ can be arranged so as to extend over several building elements or the whole wall without excessive strain and stress arising in the envelope material due to multidimensional distortions.

It has to be understood that the fore-part if desired can be constructed by using building elements of great surface dimensions, e.g. extending substantially over the height and/or over the width of the wall. Particularly building elements of unique structure, which also have to be taken in consideration, may be constructed with comparatively small wall-thickness.

Figure 10:
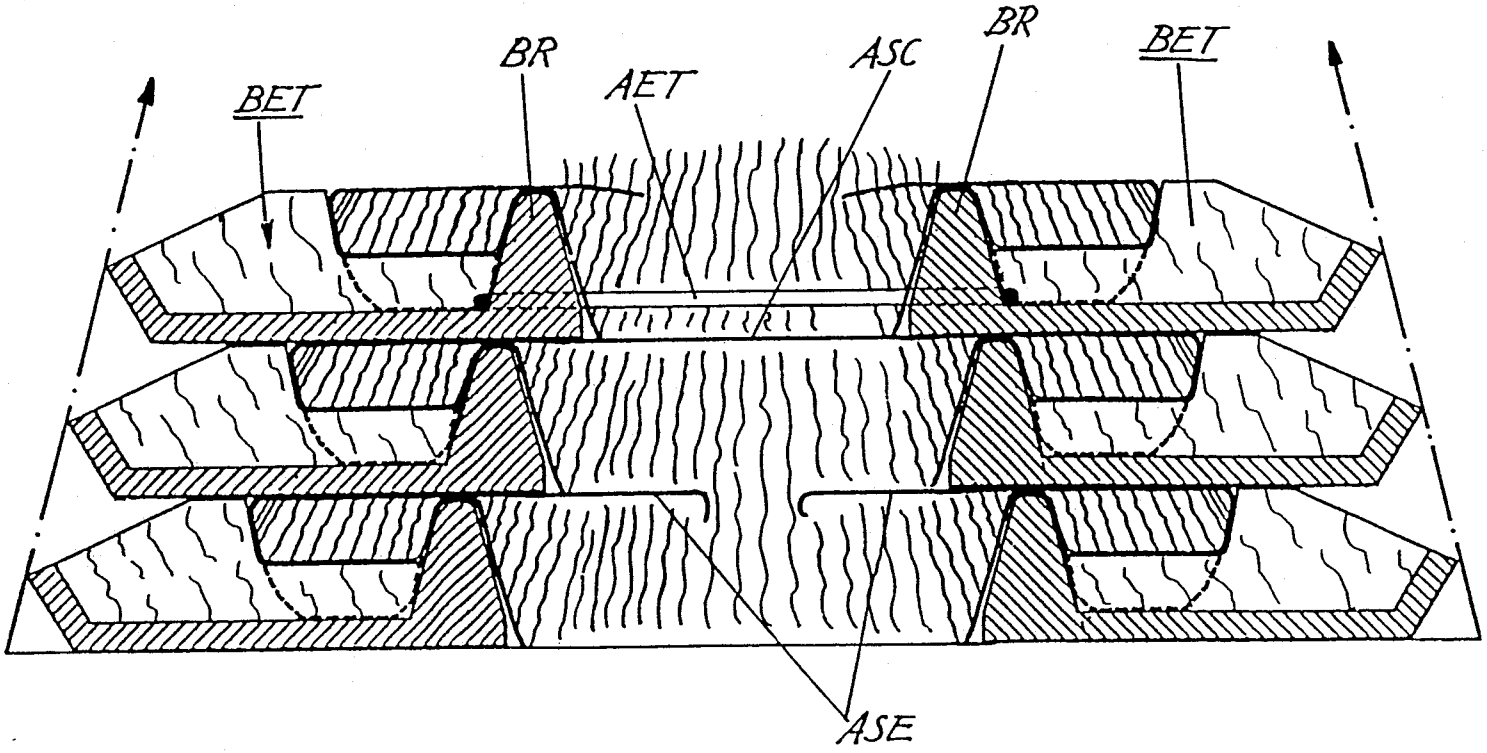
FIG. 10 is a cross-sectional side view of a stand-alone wall with opposite fore-parts comprised of trough-like building elements as shown in FIG. 8.

FIG. 10 illustrates as a further example a stand-alone wall, which can serve as a noise-absorbing or partition wall and which comprises a gravity support structure with a plurality of cells filled with bulk material and surrounded by flat and flexible envelope material. All this is in accordance with the preceding examples so that no detailed explanation is necessary thus far. Beyond the preceding examples, the wall is provided with two opposite front-sides formed by corresponding fore-parts FP1, FP2 and with a central gravity support structure CGS. The latter again comprises a plurality of compartments or cells which are filled with bulk material and surrounded or subdivided by flat and flexible envelope material FEM. The fore-parts are constructed similar to the one according to FIG. 8, i.e. consisting of superimposed, trough-like building elements BET with a back rib BR extending in longitudinal direction of the wall.

For the purpose of explanation three different modes of anchoring the fore-parts have been shown in FIG. 10:

In the lowermost stage of the wall two building elements located in opposition to each other and on the same level are both anchored independently by means of anchoring sections ASE of the envelope material being part of the bulk material cells housed in excavations of the building elements BET. The anchoring sections ASE are extending into the bulk material of the gravity support structure so as to form a substantially frictional connection therewith. Additional positive anchoring or holding parts or elements as shown in FIG.4 may be used here also.

In the following upper stage of the wall two building elements located in opposition to each other and on the same level are shown anchored to each othery by means of common anchoring section ASC of the envelope material being part of both the bulk material cells housed in excavations of the corresponding building elements. Such inexpensive construction renders favourably enhanced compound stability.

In the third stage of the wall a common anchoring mode similar as in the preceding stage has been shown, however, without making use of the envelope material of bulk material cells. Instead a common tensile anchoring element AET in the form of a rope or band is used, which surrounds the back ribs BR of both building elements and extends through the bulk material located betwen both fore-parts. It has to be pointed out that this mode of anchoring offers optimum stability due to the possibility of tensioning the common anchoring element or elements in the different stages of the wall precisely. Furthermore, optimum form stability is secured for the whole stand-alone wall.

What I claim is:

1. A wall comprising a support structure and a fore-part, said support structure including a plurality of vertically arranged compartments, said compartments being defined by flexible envelope material filled with bulk material, said fore-part including at least one projection directed upwards and at least one excavation neighboring said projection and being arranged offset in relation thereto in a direction toward a front side of said fore-part, at least one of said compartments having a first portion extending over said projection and into said excavation in said fore-part to form a positive connection with said fore-part, and said at least one compartment having a second portion extending back from said excavation over said projection into said support structure, whereby said at least one compartment is connected to said fore-part to resist horizontal forces acting between said fore-part and said support structure.

2. A wall according to claim 1 in which said fore-part comprises a plurality of building elements arranged to form a supporting grid structure.

3. A wall according to claim 1 in which said fore-part comprises a plurality of building elements arranged to form a supporting grid structure, each of said building elements having a front side and a rear side, each element having a projection located on the rear side, each of said building elements including at least one excavation neighboring said projection toward the front side of said element.

4. A wall according to claim 3 in which each of said projections is formed as a rib extending substantially parallel to the plane of the rear side of said building elements.

5. A wall according to claim 3 in which said projections are arranged serially and extend substantially parallel to the plane of the rear side of said building elements.

6. A wall comprising a central support structure and first and second fore-parts, said central support structure including a plurality of vertically arranged compartments, said compartments being defined by flexible envelope material filled with bulk material, said first fore-part located on one end of said central support structure and said second fore-part located on an opposite end of said central support structure, each of said fore-parts including at least one projection directed upwards, and at least one of said compartments having a first portion extending over said projection of said first fore-part and having a second portion extending over said projection of said second fore-part, whereby said at least one compartment is connected to said first and second fore-parts to resist horizontal forces acting between said fore-parts and said central support structure.

7. A wall according to claim 6 in which said first forepart is connected to said second fore-part by at least one anchoring structure.

8. A wall according to claim 7 in which said anchoring structure comprises at least one flexible tensile anchoring element in the form of a flat material.

9. A wall according to claim 7 in which said anchoring structure comprises at least one flexible anchoring element in the form of a rope material.

* * * * *